United States Patent [19]

Rothchild

[11] Patent Number: 4,561,453

[45] Date of Patent: Dec. 31, 1985

[54] TREATMENT OF TOBACCO UNDER PRESSURE IN A CONTINUOUS PROCESS

[76] Inventor: Ronald D. Rothchild, 106 Rynda Rd., South Orange, N.J. 07079

[21] Appl. No.: 331,142

[22] Filed: Dec. 16, 1981

[51] Int. Cl.[4] ..... A24B 3/00; A24B 3/18

[52] U.S. Cl. ..... 131/304; 131/291; 131/296

[58] Field of Search ..... 131/301, 296, 291

[56] References Cited

U.S. PATENT DOCUMENTS

| | | | |
|---|---|---|---|
| 4,165,618 | 8/1979 | Tyree | 131/291 |
| 4,253,474 | 3/1981 | Hibbitts et al. | 131/291 |
| 4,258,729 | 3/1981 | de la Burde | 131/291 |
| 4,289,148 | 9/1981 | Ziehn | 131/291 |

*Primary Examiner*—V. Millin

*Attorney, Agent, or Firm*—Hopgood, Calimafde, Kalil, Blaustein & Judlowe

[57] ABSTRACT

Methods and apparatus for treating a continuous flow of tobacco under pressure include introducing said tobacco to a pressurized chamber through an entrance lock device, impregnating said tobacco with a pressurized gas or its liquid phase within said chamber, and discharging said impregnated tobacco from said chamber through an exit lock device. Liquid impregnant may be applied as a fine spray within said chamber, and subsequent expansion of said tobacco may be performed by decompression, heating, or by decompression and heating in combination.

17 Claims, 3 Drawing Figures

TREATMENT OF TOBACCO UNDER PRESSURE IN A CONTINUOUS PROCESS

BACKGROUND OF THE INVENTION

The present invention relates to methods and apparatus for impregnating tobacco with a gas or its liquid phase, under pressure, in a continuous process with relatively compact and inexpensive equipment, for the purpose of expanding said tobacco.

Numerous processes now exist for expanding tobacco, in which said tobacco is treated with a gas or its liquid phase under pressure at some point in each of said processes. All of these processes are limited to the treatment of batches of tobacco during said pressurized treatment step and therefore require very expensive equipment, and in some cases are not industrially practical, in varying degree.

U.S. Pat. No. 4,165,618 describes a complex system of autoclaves and holding chambers to submerge tobacco in liquid $CO_2$ at a very high pressure. Subsequently a portion of said liquid $CO_2$ is removed from said autoclaves, leaving behind that liquid which has impregnated the tobacco. In the commercially available DIET process for expanding tobacco, vessels containing tobacco which has been impregnated with said liquid are than vented to atmospheric pressure so that a portion of said liquid is converted to dry ice within said tobacco. Said tobacco is then heated to rapidly convert said dry ice to gas, to expand said tobacco and to fix it in its expanded condition.

A United Kingdom patent describes a process which is similar in that tobacco is impregnated with liquid $CO_2$ and then vented to convert said liquid to dry ice, and then heated to effect and fix the expansion of said tobacco. However the initial impregnation of said tobacco with said liquid is performed in this case with a spray of said liquid rather than by submersion.

U.S. Pat. No. 4,250,898 describes a process in which tobacco is impregnated with $CO_2$ gas under pressure and then chilled to about $-90°$ F. to convert said gas to dry ice within said tobacco. Said dry ice impregnated tobacco is then heated, to effect and fix the expansion of said tobacco.

The process described in U.S. Pat. No. 4,250,898 is inherently a batch process and a cumbersome procedure for industrial application. However it demonstrates that tobacco may be effectively impregnated with $CO_2$ at a pressure as low as about 50 psig, provided that said impregnation step is controlled and limited, which control is not possible if said tobacco is impregnated by submersion in liquid. This is significant because pressure in this range can practically be achieved and maintained with substantially different and simpler equipment, as compared with higher pressures such as over about 100 psig.

There is still another and more extreme high pressure process in which tobacco is soaked in nitrogen gas at pressures in the order of thousands of psi. When the vessel containing said pressurized tobacco is vented, said tobacco is expanded by decompression. Said tobacco is then heated, but in this case said heating step serves only to fix the already expanded tobacco in its expanded condition. However expansion by this process is dependent upon the pressure differential between the inside and outside of said tobacco during decompression. Said pressure differential is in turn influenced by the rate of decompression, which relatively slow in the venting of a vessel through a valve. The same level of said pressure differential can be obtained with substantially lower initial pressure, provided that the rate of decompression is made very rapid.

Accordingly the prior art exhibits a clear need for a simple and continuous technique incorporating the treatment of tobacco under pressure with a gas or its liquid phase, in order to expand said tobacco.

It is an object of the present invention to provide methods and apparatus, for the impregnation of tobacco under pressure, which are relatively inexpensive, continuous in operation, and relatively convenient in an industrial environment.

It is a further object of the invention to provide flexibility in terms of the type and form of expanding agent to be used.

SUMMARY OF THE INVENTION

In accordance with the present invention a continuous flow of tobacco is transported across a pressure boundary, from a lower to a higher pressure, preferably in the pockets of an entrance rotary lock device. Said tobacco remains in the region of said higher gas pressure for whatever period of time is required for its treatment, during which time it may be sprayed with the liquid phase of said pressurized gas. At the conclusion of said treatment period said flow of tobacco is removed from said region of higher gas pressure, again preferably being transported out of said region in the pockets of an exit rotary lock device.

Preferably, the continuous flow of tobacco is maintained within said higher pressure region by transporting said tobacco from said entrance to said exit rotary lock device on a conveyer or in a tumbler within said region.

BRIEF DESCRIPTION OF THE DRAWINGS

The invention will be more clearly understood by reference to the following description of exemplary embodiments thereof in conjunction with the following drawings in which.

DETAILED DESCRIPTION OF THE INVENTION

Figure 1:
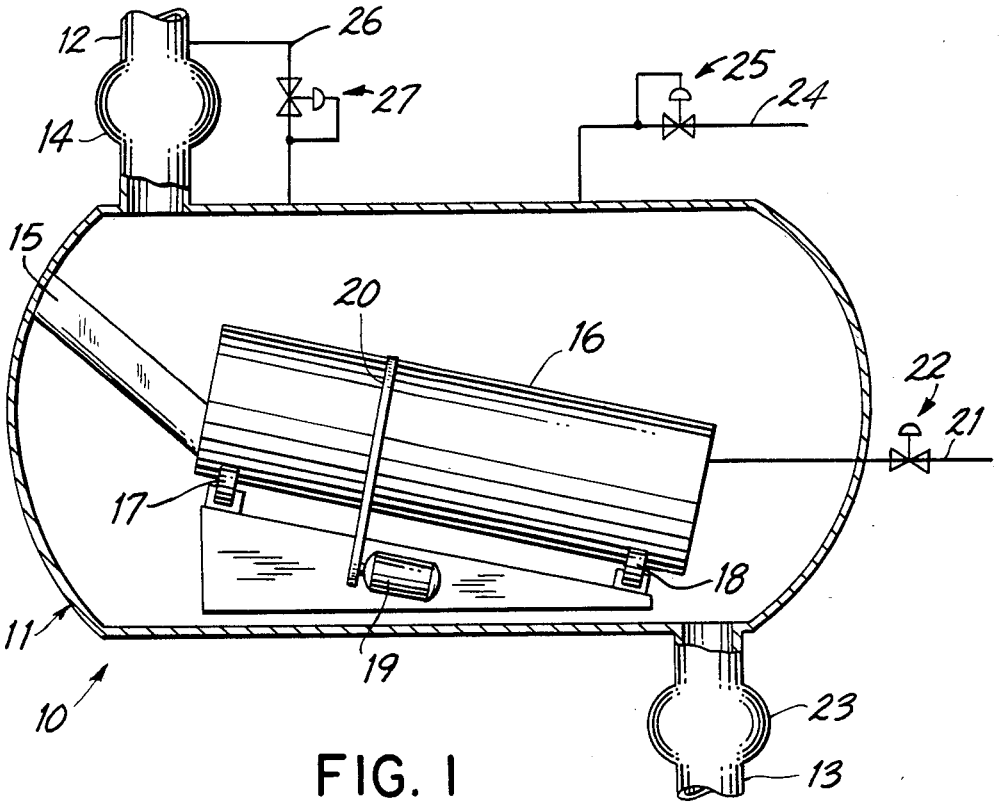
FIG. 1 is a diagrammatic view of an exemplary embodiment of apparatus for treating a continuous flow of tobacco under pressure in accordance with the present invention.

This invention relates to a means for impregnating a continuous flow of tobacco with a gas or its liquid phase, with said impregnation being performed at a pressure of preferably up to about 100 psig. In accordance with the invention, said tobacco is introduced from a region of substantially atmospheric pressure, through an entrance lock, to the interior of a chamber in which gas pressure is maintained at the level required for treatment. For example, if said treatment is the impregnation of tobacco with liquid $CO_2$, then said gas pressure may preferably be maintained slightly above about 60 psig, which is the triple point pressure of $CO_2$.

Alternatively if said treatment is the impregnation of tobacco with nitrogen gas, for example, then said gas pressure may be maintained at a higher level. However the maximum pressure at which said gas pressure may be maintained will be limited by the ability of said entrance lock (and and exit lock as well) to withstand the pressure differential between the interior and exterior of said chamber.

If very high pressure is required for said treatment of said tobacco, then said tobacco may enter said chamber through multiple locks in series, with each of said locks sustaining only a portion of said pressure differential. Multiple locks in series may also be utilized at the exit of said chamber, depending on the pressure level of the region to which said tobacco is discharged through said exit. However the number of locks in series, and therefore the treatment pressure in said chamber, will be practically limited by consideration of the size, complexity and cost of equipment, and by the effect on said tobacco of multiple pressure shocks. Preferably there is only one lock device at the entrance to said chamber, and one at the exit, and pressure in said chamber is maintained below about 100 psig.

Said entrance lock may be, for example, a star-wheel valve with said tobacco entering the pockets of said valve from above, being transported into the region of higher gas pressure by the rotation of said valve, and falling out of said valve by gravity into said chamber. If a star-wheel valve is used, however, a portion of said pressurized gas will be lost in the return of said pockets from said region of higher pressure below to the region of lower pressure above, in the rotation of said valve. This may be an economic disadvantage in some cases.

For example, if said tobacco is to be impregnated with liquid $CO_2$ at about 65 psig, then the corresponding $CO_2$ saturation temperature to which tobacco must be chilled in said chamber is about −67° F., and said gas in said chamber will be at substantially that temperature. In this case, the loss of said gas through said entrance lock may not be an economic burden, as said gas flowing back up against said flow of tobacco may be used to prechill it prior to its entrance into said chamber, thereby requiring less cryogen use within said chamber.

Depending on the relative costs of liquid $CO_2$ and equipment in a particular location, however, it may be preferable to prechill said tobacco, if at all, by conventional refrigeration means prior to its entrance into said chamber, and to conserve said $CO_2$. In this case, said entrance lock may be a rotary lock with two conjugate lobed rotors, similar to certain positive displacement compressors, which would allow little or no loss of said gas through said entrance lock.

Upon falling from said entrance lock into said chamber, said flow of tobacco preferably falls onto or into a conveying device within said chamber. If said impregnation to be performed within said chamber is with pressurized gas, then said conveying device may be a simple belt conveyer. However if the treatment temperature within said chamber is very low, care must be taken in the selection of the belt material, which may be segmented metal construction, for example, or one of several commercially available polymer materials compounded for low temperature service.

If said impregnation to be performed within said chamber is, for example, with liquid $CO_2$, then said conveying device is preferably a large tube, with its axis inclined slightly from the horizontal such that tobacco enters said tube at its higher end and exits at its lower end. Said tobacco is both tumbled and conveyed within said tube as said tube is rotated about its axis. A liquid such as $CO_2$ may be contacted with said tobacco as a fine spray within said tube, and will be evenly distributed in the tobacco due to the tumbling action therein. This is similar mechanically, for example, to the spraying of $CO_2$ snow in a tumbler for food freezing or of liquid flavorings onto tobacco. The tumbling action yields uniform distribution of the sprayed with the tumbled material, though those examples are normal atmospheric pressure processes.

For example, if said tobacco enters said chamber at substantially ambient temperature, and if liquid $CO_2$ at its normal storage temperature of about 0° F. is sprayed into said tumbling tobacco, and if it is desired that said tobacco be impregnated with dry ice upon exiting said chamber and being decompressed back to substantially atmospheric pressure, then at least about 1.6 lb of liquid $CO_2$ should be sprayed into said chamber for each 1 lb of said tobacco passing therethrough, which will result in about 1 lb of liquid $CO_2$ remaining in each 1 lb of tobacco as an impregnant.

Preferably, however, said liquid $CO_2$ may be prechilled by conventional means to about −60° F. before it is sprayed into said chamber, which will reduce the amount of said $CO_2$ required by about 20%, and will also facilitate the flow control of said liquid $CO_2$ by preventing cavitation in a control valve.

However if it is not desired that dry ice be formed in any subsequent decompression of said tobacco, then the amount of said liquid sprayed onto said tobacco may be further reduced. For example, if only about 0.1–0.2 lb of liquid impregnate the tobacco at decompression, no dry ice will remain but said decompression, performed rapidly, will effect the instantaneous conversion of said liquid into gas and thereby expand said tobacco. A subsequent heating step is then required to fix said tobacco's expanded condition.

Alternatively, said tobacco may exit said chamber directly into a heating zone which is also maintained at a high pressure. In this case again, no dry ice will be formed in said tobacco and only about 0.1–0.2 lb of said liquid $CO_2$ in said tobacco will be sufficient to expand said tobacco, being converted rapidly to gas by the heat applied in said heating zone.

It is therefore clear that the exact conditions under which said tobacco is treated in said chamber will vary in accordance with the conditions under which said tobacco is to be treated upon exiting said chamber.

If said tobacco is to be impregnated with pressurized gas within said chamber, then gas may be supplied to said chamber in sufficient quantity to maintain said pressure by means of a simple pressure regulator. However if said impregnation is to be with a liquified gas, then two supplies may be preferred; one of said liquified gas to maintain the level of said liquified gas present in said tobacco as an impregnant upon exiting said chamber, and one of said gas in its vapor phase to maintain chamber pressure. This will allow independent control of said impregnant level and chamber pressure.

Additionally said chamber should also be provided with a back pressure regulator, set at a slightly higher pressure than said gas supply pressure regulator, to prevent overpressure in said chamber with regard both to safety and process conditions. Preferably, said gas vented through said back pressure regulator should be vented to the region just above said input lock, so that any gas entering said chamber through said input lock may be similar to that already in it.

Said tobacco exits said chamber through an exit lock which may be similar to said entrance lock. A lock with two conjugate lobed rotors should be used here if gases present immediately outside the exit lock could constitute a contaminant if allowed to enter said chamber. In this case said lock will tend to act as a gas pressure driven motor rather than as a compressor, and should be braked rather than driven by a motor. Alternatively, said exit lock may be mechanically coupled to said entrance lock so as to provide a portion of the shaft power required to drive said entrance lock.

It is in the nature of devices such as the star-wheel valve, or the lobed compressor with two rotors, that decompression of said tobacco is substantially instantaneous in said exit lock, as each pocket of said star-wheel or lobed rotor containing tobacco and gas under pressure comes in communication with the region below said lock, if that region is at a lower pressure than said gas pressure within said chamber. This characteristic of said lock devices may be used to advantage, depending on the nature of subsequent processing.

For example, if said tobacco is impregnated with nitrogen at 60 psig in said chamber, and is decompressed by said exit lock to substantially atmospheric pressure, then the pressure differential between the inside and outside of said tobacco will be instantaneously about 60 psig despite the porosity of said tobacco, and said tobacco will be expanded by said rapid decompression and require subsequent heating only to fix its expanded condition.

Alternatively said tobacco may be impregnated with, for example, 0.1–0.2 lb of liquid $CO_2$ per 1 lb of tobacco, at about 65 psig, and then rapidly decompressed to substantially atmospheric pressure. Then the pressure differential between the inside and outside of said tobacco will be about 65 psig on decompression, and this pressure differential will be maintained for a longer period than is the case with said gas impregnation, due to the reservoir of said liquid within said tobacco which forms new gas to replace that which leaves said tobacco due to its porosity. Thus such impregnation with liquid will lead to a higher level of expansion than said gas impregnation, but at a higher cost in gas usage.

By way of further example, said tobacco may be impregnated with more than 1 lb of liquid $CO_2$ per 1 lb of tobacco in said chamber, and then rapidly decompressed to substantially atmospheric pressure to form dry ice within said tobacco. In this case said tobacco will be expanded upon decompression and may be still further expanded by subsequent heating to convert said dry ice rapidly to gas. The subsequent step in which dry ice impregnated tobacco is heated may be similar to that used in the well known, commercially available DIET process for tobacco expansion, but the impregnation step according to the present invention will be performed in smaller, simpler and less expensive equipment, in a continuous rather than batch operation.

It is also possible to postpone said decompression and to use said exit lock solely for the isolation of gases inside said chamber. For example, said tobacco may be impregnated with about 0.1–0.2 lb of liquid $CO_2$ per 1 lb of tobacco at about 65 psig before being transported through said exit lock directly into a heating zone, also maintained at about 65 psig. Rapid heating will then convert said liquid to a gas to effect the expansion and fix it, analogous to the well known and commercially available G13 process for tobacco expansion but using $CO_2$ instead of organic chemicals as the liquid expanding agent. In this case, said expanded tobacco must then be discharged from said heating zone through a lock capable of sustaining said 65 psig pressure differential.

From the foregoing it will be apparent that the method of treating a continuous flow of tobacco under pressure will be very versatile as a key step in expansion processes. Such treatment under pressure may be achieved by use of a system which will now be described.

With reference to FIG. 1, illustrated therein is an exemplary embodiment of apparatus for carrying out the present invention for the purpose of impregnating tobacco with liquid $CO_2$. Apparatus 10 for the treatment of tobacco under pressure includes a pressure vessel 11, entrance conduit 12 and exit conduit 13 for the flow of said tobacco. Said tobacco is transported into said vessel 11 against the gradient of pressure therein by means of entrance lock 14 in conduit 12. Said tobacco then falls out of said entrance lock 14 onto chute 15 and flows by gravity down said chute 15 into inclined tumbling cylinder 16, which is supported on rollers 17 and 18 and driven by motor 19 via a belt or chain, 20. Tobacco is then tumbled and transported toward the lower end of tumbling cylinder 16 by the rotation thereof.

Meanwhile, liquid $CO_2$ is introduced into vessel 11 via conduit 21, regulated by valve 22, and discharged inside tumbling cylinder 16 as a fine spray through one or more spray nozzles of conventional design (not shown). Said fine spray of a regulated flow of liquid $CO_2$ into said tumbling tobacco leads to uniform and controlled impregnation of said tobacco with said liquid.

Impregnated tobacco is discharged from the lower end of said tumbling cylinder 16 into exit conduit 13 and passes through exit lock 23, which may serve to isolate the gas within vessel 11 from gas below said exit lock 23 and/or also to maintain the gas pressure within said vessel 11.

Pressure is kept from falling too low within vessel 11 by the introduction of $CO_2$ gas, as needed, through conduit 24 and pressure regulator 25. The process and vessel 11 are protected against any overpressure by release of gas through conduit 26 and back pressure regulator 27, to the region of conduit 12 just above entrance lock 14.

Figure 2:
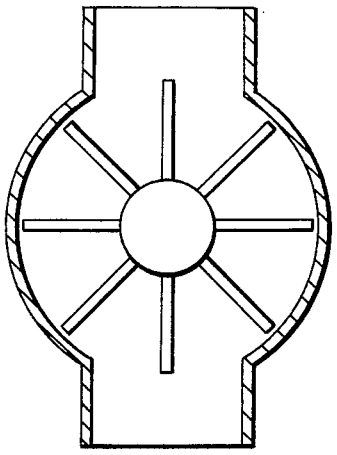
FIG. 2 is a diagrammatic view of a star-wheel valve which may be utilized as an entrance and/or exit lock.

FIG. 2 illustrates a star-wheel valve which may be used as a simple rotary lock device for the purpose of carrying out the method of the present invention.

Figure 3:
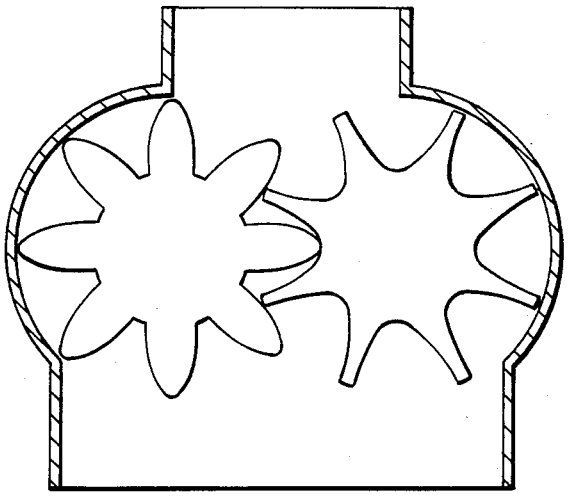
FIG. 3 is a diagrammatic view of a twin rotor, positive displacement compressor-lock device with conjugate lobes on its rotors which may also be utilized as an entrance and/or exit lock.

FIG. 3 is a diagrammatic view of a lock device with two conjugate lobed rotors which can provide a more effective, albeit more expensive, seal by virtue of its conjugate design.

The foregoing and other various changes in form and details may be made without departing from the spirit and scope of the present invention. Consequently, it is intended that the appended claims be interpreted as including all such changes and modifications.

What is claimed is:

1. A method of treating tobacco under pressure, the improvement comprising the steps of:

a. delivering a continuous flow of said tobacco to a continuously operating entrance lock into a closed chamber containing a pressurized gas, b. passing said tobacco continuously through said entrance lock into said chamber, c. transporting said tobacco continuously through said chamber, d. impregnating said tobacco with said pressurized gas within said chamber, and e. discharging said impregnated tobacco from said chamber through a continuously operating exit lock.

2. The method as defined in claim 1 wherein said entrance and exit locks each comprise a single lock device, and the pressure of said pressurized gas is less than about 100 psig.

3. The method as defined in claim 1 or 2 wherein the step of transporting said tobacco within said chamber takes place on at least of a belt conveyor and a tumbling cylinder.

4. The method as defined in claims 1 or 2 wherein the pressure outside said exit lock is substantially atmospheric, and the decompression of said tobacco upon exiting said chamber through said exit lock is substantially instantaneous.

5. The method as defined in claim 4 wherein said tobacco is impregnated with said pressurized gas, which is an inert gas such as nitrogen or carbon dioxide.

6. The method as defined in claims 1 or 3 wherein said tobacco is impregnated with the liquid phase of said pressurized gas.

7. The method as defined in claim 6 wherein said pressurized gas is carbon dioxide and is maintained in said chamber at a pressure of at least about 60 psig.

8. The method as defined in claim 7 wherein each pound of said tobacco passing through said chamber is impregnated with at least about 1 pound of liquid carbon dioxide and is then discharged from said chamber through said exit lock to a region of substantially atmospheric pressure.

9. The method as defined in claim 7 wherein each pound of said tobacco passing through said chamber is impregnated with at least about 0.1 pounds of liquid carbon dioxide and is then discharged from said chamber through said exit lock to a region of substantially atmospheric pressure, and the decompression of said tobacco upon its discharge is substantially instantaneous.

10. The method as defined in claim 7 wherein each pound of tobacco passing through said chamber is impregnated with at least about 0.1 pounds of liquid carbon dioxide and is then discharged from said chamber to a heating zone maintained at a pressure substantially similar to that in said chamber, said tobacco being subsequently discharged from said pressurized heating zone through an additional lock device.

11. The method as defined in claims 6 or 7 wherein said liquid phase is applied to said tobacco as a fine spray.

12. Apparatus for treating a continuous flow of tobacco under pressure, the improvement comprising means for:

a. delivering a continuous flow of said tobacco to a continuously operating entrance lock into a closed chamber containing a pressurized gas, b. passing said tobacco continuously through said entrance lock into said chamber, c. transporting said tobacco continuously through said chamber, d. impregnating said tobacco with said pressurized gas within said chamber, and chamber through a continuously operating exit lock, and e. discharging said impregnated tobacco from said chamber through a continuously operating exit lock.

13. Apparatus as defined in claim 12 further comprising means of substantially instantaneously decompressing said impregnated tobacco upon its discharge from said chamber through said exit lock.

14. Apparatus as defined in claim 12 further comprising means of impregnating said tobacco with a fine spray of said liquid phase.

15. Apparatus as defined in claim 12 further comprising means of heating said impregnated tobacco under pressure subsequent to its discharge from said chamber.

16. Apparatus as defined in claim 12 wherein at least one of said locks comprises two lobed rotors in conjugate rotation.

17. Apparatus as defined in claim 12 wherein the means for transporting said tobacco within said chamber comprise at least one of a belt conveyor and a tumbling cylinder.

* * * * *

Disclaimer and Dedication 4,561,453.—*Ronald D. Rothchild,* South Orange, N.J. TREATMENT OF TOBACCO UNDER PRESSURE IN A CONTINUOUS PROCESS. Patent dated Dec. 31, 1985. Disclaimer and Dedication filed Mar. 24, 1986, by the *inventor.*

Hereby disclaims and dedicates to the Public claims 1, 2, 3, 4, 6, 12, 13 and 17, inclusive of said patent.

[*Official Gazette May 27, 1986.*]